US005810980A

United States Patent [19]

Edelson

[11] Patent Number: 5,810,980

[45] **Date of Patent: *Sep. 22, 1998**

[54] LOW WORK-FUNCTION ELECTRODE

[75] Inventor: Jonathan Sidney Edelson, Hillsboro, Oreg.

[73] Assignee: Borealis Technical Limited, London, England

[ * ] Notice: The term of this patent shall not extend beyond the expiration date of Pat. No. 5,675,972.

[21] Appl. No.: 744,574

[22] Filed: Nov. 6, 1996

[51] Int. Cl.[6] ..... C25B 11/00

[52] U.S. Cl. ..... 204/290 R; 204/290 F; 313/310; 313/311

[58] Field of Search ..... 204/403, 290 R, 204/418, 290 F, 282; 313/310, 311

[56] References Cited

U.S. PATENT DOCUMENTS

| | | | |
|---|---|---|---|
| 4,484,989 | 11/1984 | Mansell | 204/296 |
| 5,128,587 | 7/1992 | Skotheim et al. | 313/504 |
| 5,675,972 | 10/1997 | Edelson | 313/310 |

*Primary Examiner*—Bruce F. Bell

[57] ABSTRACT

A metal surface is coated with a heterocyclic multidentate ligand compound, reducing work function and facilitating the emission of electrons.

15 Claims, 3 Drawing Sheets

LOW WORK-FUNCTION ELECTRODE

BACKGROUND

Field of the Invention

The present invention relates to electrodes as used in vacuum electronic systems and structures enabling a current of electrons to flow between a metallic conductor and another body.

Background: Electron Devices

Vacuum electronic devices employ a flow of electrons through a vacuum space between a cathode and an anode. Through manipulation of the voltages of intermediate electrodes, the use of magnetic fields, or other techniques, various desired end results may be achieved. For example, placing a grid like electrode between cathode and anode permits a small signal applied to said grid to greatly influence the flow of current from cathode to anode: this is the vacuum triode used for amplification. Operation of these devices depends upon the ability of the cathode to emit electrons into the vacuum.

Devices employing current flowing through a gas also require electrodes which easily emit electrons. Further, propulsion devices which operate on the principal of current flowing through diffuse plasmas in magnetic fields also depend heavily on the ability of electrodes to easily emit electrons.

Most such devices make use of the heated thermionic cathode. In such a cathode, a metal or oxide coated metal is heated until thermally excited electrons are capable of escaping from the metal.

Such thermionic cathodes are capable of operation at current densities up to several hundreds of amperes per square centimeter. Such devices still find active use in high power devices such as are found in radio transmitters, however at the small scale the solid state transistor has virtually replaced the vacuum tube in all uses.

Background: Work Function

A measure of the difficulty of the escape of an electron from an electrode is given by the work function. The work function is the amount of work needed to pull an electron from a bulk neutral material to the vacuum level, generally measured in electron volts. In a thermionic cathode, this work is supplied by the kinetic energy of the thermally excited electron; rapidly moving electrons are slowed down as they leave the metal, and most electrons do not have sufficient speed to escape and are thus pulled back. However a small fraction of the electrons have enough kinetic energy so as to be able to escape from the cathode.

The lower the work function of the electrode, the greater the number of electrons which will be capable of escaping from the cathode. If increased current density is not needed, then the lower work function will allow for operation at lower temperatures. Extremely low work function devices would allow the operation of vacuum electron devices at room temperature, without a heated cathode.

Background: Electrides

Electrides are organo-metallic compounds comprised of an alkali metal cation, an alkaline earth metal cation, or a lanthanide metal cation, complexed by a multidentate cyclic or poly-cyclic ligand. This ligand so stabilizes the cation that the electron may be considered free from the metal. In solution, electrides consist of the metal-ligand structure in solution as the cation, and free electrons in solution as the anion. Electrides form ionic crystals where the electrons act as the anionic species.

Ligands known to form electrides are cyclic or bicyclic polyethers or polyamines include the crown ethers, cryptands, and aza-crown ethers. Materials which are expected to form electrides include the thio analogs to the crown ethers and the cryptands, as well as the silicon analogs thereto.

Background: Vacuum Diode-Based Devices with Electride-Coated Electrodes.

In my previous disclosure, entitled "Method and Apparatus for Vacuum Diode-Based Devices with Electride-Coated Electrodes", application Ser. No. 08/719792, filed Sep. 25, 1996, I describe the use of electride materials to produce electrodes of low work-function for use in vacuum thermionic devices for energy conversion.

In this previous disclosure, I teach the use of bulk electride coatings on conductors. While electrides have demonstrated low temperature thermionic emission, they present several negative attributes. Electrides are thermodynamically unstable, and decompose if not kept at cryogenic temperatures. Electrides also exhibit poor electrical conductivity. In my previous disclosure I specified a new use for the known ability of electrides to thermionically emit electrons.

BRIEF DESCRIPTION OF INVENTION

Broadly, the present invention consists of a bulk metal coated with a layer of a complexing ligand capable of forming an electride. The ligand stabilizes the loss of electrons by surface sites on the metal, lowering the work-function of the coated surface. Rather than a thick layer of electride, a thin layer of ligand modifies the electronic structure of the surface of the metal. The bulk metal provides the necessary electrical conductivity. Hot electrons escape the surface, and do not remain to degrade the ligand structure.

In one embodiment of the present invention, said metal is an alkali metal, alkaline earth metal, lanthanide metal or an actinide metal.

In another embodiment, said metal is an alloy comprising a mixture of one or more of alkali metals, alkaline earth metals, lanthanide metals, actinide metals and other metals.

In a further embodiment, the electride-forming ligand is coated in a monolayer on the metal surface.

In a yet further embodiment, a bulk conductor is plated with a thin layer of alkali metal, alkaline earth metal, lanthanide metal, or actinide metal which is itself coated with a monolayer of electride-forming ligand.

OBJECTS AND ADVANTAGES

It is an object of the present invention to provide for low work function electrodes.

An advantage of the present invention is that lower cathode temperatures may be used in vacuum electron devices.

An advantage of the present invention is that unheated cathodes may be used in vacuum electron devices.

An advantage of the present invention is that the efficiency of thermionic converters may be improved.

An advantage of the present invention is that microelectronic thermionic devices are facilitated.

It is an object of the present invention to provide low work function electrodes which in the main use similar materials to electrodes already in commercial use.

An advantage of the present invention is that it may be integrated into current production technology.

An advantage of the present invention is that it may be retrofit into existing products.

REFERENCE NUMERALS IN DRAWINGS

1 Metal Electrode
1*a* Conductive Substrate
1*b* Metal Layer
2 Layer of Complexing Ligand

DESCRIPTION OF DRAWINGS

FIG. 2*a* is the general structure of the crown-ethers.

FIG. 2*b* is the general structure of the cryptands.

FIG. 2*c* is the general structure of the aza-crown-ethers.

FIG. 2*d* is the general structure of the silicone-crown-ethers.

FIG. 2*e* is the general structure of the thio-crown-ethers.

FIG. 3*a* is the structure of 18-crown-6.

FIG. 3*b* is the structure of 15-crown-5.

FIG. 3*c* is the structure of cryptand [2.2.2].

FIG. 3*d* is the structure of hexamethyl hexacyclen.

DESCRIPTION OF INVENTION

Figure 1A:
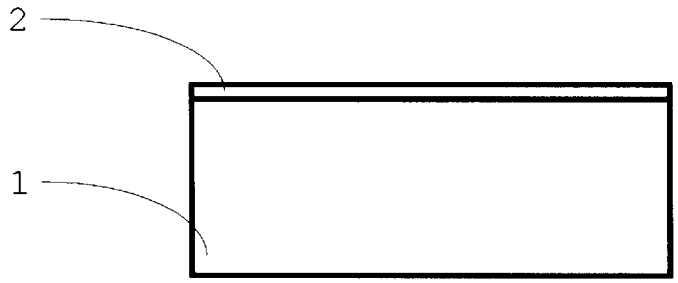
FIGS. 1*a* and 1*b* show diagrammatic representations of the low work-function electrode of the present invention.

Referring to FIG. 1*a*, metal electrode 1 is coated with a layer of complexing ligand 2.

In a preferred embodiment, complexing ligand layer 2 is coated in a monolayer upon the surface of metal electrode 1.

Figure 1B:
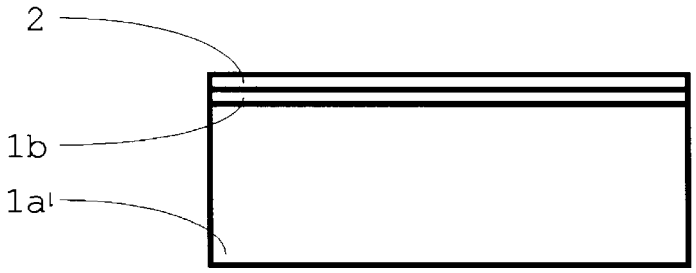

Referring to FIG. 1*b*, conductive substrate 1*a* is coated first with a layer of metal 1*b*, forming a composite metal electrode, and secondly, with a layer of completing ligand 2.

Description of Invention: Composition of Metal Electrode 1

In a preferred embodiment, metal electrode 1 is composed of an alkali metal, an alloy of alkali metals, or an alloy of alkali metal and other metals. Metal electrode 1 may also consist of an alkaline earth metal, a lanthanide metal, an actinide metal, alloys thereof, or alloys with other metals.

In another preferred embodiment, metal electrode 1 is composed of a conductive substrate 1*a* plated with a metal plating 1*b*, said metal plating being an alkali metal, an alloy of alkali metals, or an alloy of alkali metal with another metal. Metal plating 1*b* may also consist of an alkaline earth metal, a lanthanide metal, an actinide metal, alloys thereof, or alloys with other metals.

The alkali metals are lithium, sodium, potassium, rubidium, cesium, and francium. The alkali earth metals are beryllium, magnesium, calcium, strontium, barium, and radium. The lanthanide metals are lanthanum, cerium, praseodymium, neodymium, promethium, samarium, europium, gadolinium, terbium, dysprosium, holmium, erbium, thulium, ytterbium, lutetium, and hafnium. The actinide metals include actinium, thorium, protactinium, uranium, and the transuranic metals.

Description of Invention: Complexing Ligands

Figure 2A:
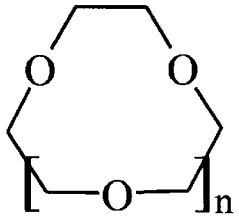
FIGS. 2*a*–2*e* show the general chemical structures of some electride-forming ligand families.
Figure 2B:
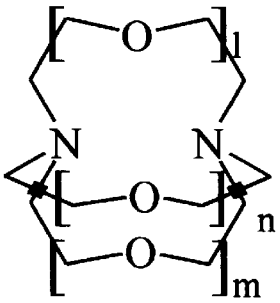
Figure 2C:
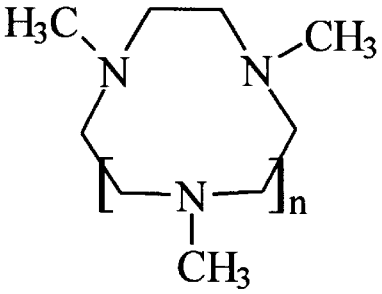
Figure 2E:
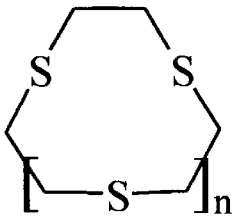
Figure 2D:
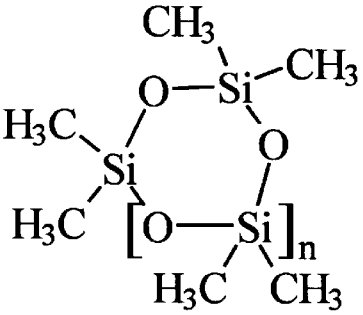

Referring to FIG. 2*a*–2*e* we see chemical structures for various classes of complexing ligands. FIG. 2*a* is the general structure of the crown-ethers. The crown-ether is a cyclic structure composed of repeated instances of $CH_2$—$CH_2$—O. The oxygen atoms make available non-bonding electron pairs which act to stabilize metal cations. FIG. 2*b* is the general structure of the cryptands. The general structure is a bicyclic poly-ether, composed of repeated instances of $CH_2$—$CH_2$—O, combined with nitrogen 'end-links' which allow for the addition of a third poly-ether chain. FIG. 2*c* is the general structure of the aza-crown-ethers. The aza-crown-ether, or cyclen, is a cyclic structure composed of repeated instances of $CH_2$—$CH_2$—NX, where X is $CH_3$. The nitrogen atoms each make available a single non-bonding electron pair to stabilize metal cations, while being more stable than the oxygen crown-ethers. FIG. 2*d* is a silicone analog to the crown-ethers, a cyclic structure composed of repeated instances of $Si(CH_3)_2$—O. FIG. 2*e* is the general structure of the thio-crown-ethers. The thio-crown-ether is a cyclic structure composed of repeated instances of $CH_2$—$CH_2$—S. The sulfur atoms make available non-bonding electron pairs which act to stabilize metal cations.

Figure 3A:
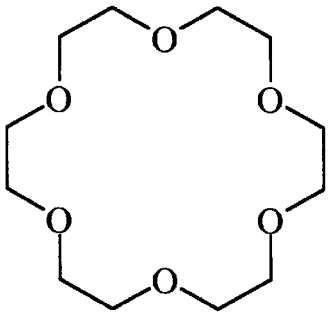
FIGS. 3*a*–3*d* show the specific chemical structures of some known electride forming ligands.
Figure 3B:
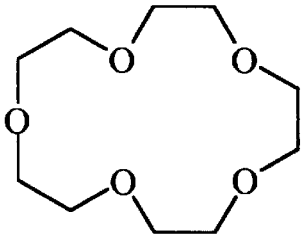
Figure 3C:
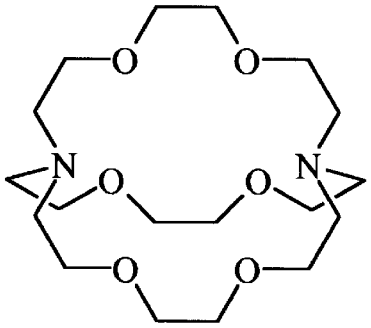
Figure 3D:
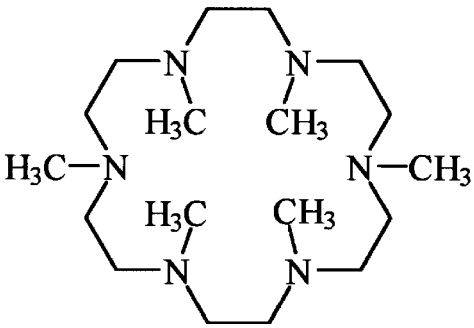

Referring to FIGS. 3*a*–3*d*, we see specific examples of complexing ligands known to form electrides and alkalides. FIG. 3*a* is 18-Crown-6, also known by the IUPAC name 1,4,7,10,13,16 hexaoxacyclooctadecane. FIG. 3*b* is 15 Crown 5, also known by the IUPAC name 1,4,7,10,13-pentoxacyclopentadecane. FIG. 3*c* is Cryptand [2,2,2], also known by the IUPAC name 4,7,13,16,21,24-hexoxa-1,10-diazabicyclo-[8,8,8]-hexacosane.

Description of Invention: Preferred Embodiments

In a particularly preferred embodiment, metal electrode 1 is composed of nickel substrate l*a*, with metal electrode plating 1*b* being sodium, potassium, francium, or cesium. Layer of complexing ligand 2 is composed of 15-Crown-5 or 18-Crown-6 in a monolayer. Both alkaline plating 1*b* and crown ether layer 2 may be produced by vacuum sublimation.

In yet another particularly preferred embodiment, metal electrode 1 is composed of nickel substrate 1*a*, with metal electrode plating 1*b* being sodium, potassium, francium, or cesium. Layer of complexing ligand 2 is composed of hexamethyl hexacyclen, known by the IUPAC name 1,4,7,10,13,16-hexaaaza-1,4,7,10,13,16-hexamethylcyclooctadecane, in a monolayer. Both alkaline plating 1*b* and cyclen layer 2 may be produced by vacuum sublimation.

In yet another particularly preferred embodiment, metal electrode 1 is thoriated tungsten. Said cathode is produced in the conventional fashion and baked prior to coating with layer of complexing ligand 2 to ensure a layer of thorium on the surface beneath layer 2.

In yet another particularly preferred embodiment, metal electrode 1 is carburized thoriated tungsten. Said cathode is produced in the conventional fashion and baked and carburized prior to coating with a layer of complexing ligand 2 to ensure a layer of thorium carbide and tungsten carbide on the surface beneath layer 2.

In yet another particularly preferred embodiment, metal electrode 1 is cesiated tungsten. Said cathode is produced in the conventional fashion, and processed prior to coating with layer of complexing ligand 2 to ensure a layer of cesium on the surface beneath layer 2.

SUMMARY, RAMIFICATION, AND SCOPE

The essence of the present invention is the use of heterocyclic multidentate ligands to stabilize the emission of electrons from a metal. This provides electrodes with low work-function.

Specific metals and ligands have been described, however other metals may be considered, as well as other ligands. For example, stable transition metals such as copper, gold, or platinum may have their work function reduced sufficiently to be useful in specific applications.

Although the above specification contains many specificities, these should not be construed as limiting the scope of the invention but as merely providing illustrations of some of the presently preferred embodiments of this invention. For example, no specification has been given for surface morphology. While the specification is for a layer of ligand upon a surface, this surface may be flat, formed into a shape suitable for a particular application, microstructured to enhance emission using field emission techniques, microstructured to increase surface area, or otherwise altered in physical configuration.

No specification has been given for electrode size. While large area electrodes such as are used in conventional vacuum tubes, thermionic converters, and the like are facilitated by the present invention, microfabricated vacuum electronic devices are also possible. The present invention may be used to facilitate the production of flat panel displays, integrated vacuum microcircuits, or vacuum microelectronic mechanical systems.

Thus the scope of the invention should be determined by the appended claims and their legal equivalents, rather than by the examples given.

I claim:

1. An electrode, consisting of: a metal having a surface which is directly coated with a layer of a heterocyclic multidentate ligand.

2. The electrode of claim 1 wherein said metal is chosen from the group consisting of alkali metals, alkali earth metals, lanthanide metals, and actinide metals.

3. The electrode of claim 1 wherein said metal is an alloy including at least one metal selected from the group consisting of alkali metals, alkali earth metals, lanthanide metals, and actinide metals.

4. The electrode of claim 1 wherein said metal is coated onto a conducting substrate.

5. The electrode of claim 1 wherein said heterocyclic multidentate ligand is chosen from the group consisting of crown-ethers, cryptands, aza-crown-ethers, cyclic-silicones, and thio-crown-ethers.

6. The electrode of claim 1 wherein said heterocyclic multidentate ligand is chosen from the group consisting of 15-Crown-5, 18-Crown-6, Cryptand [2.2.2] and hexamethyl hexacyclen.

7. The electrode of claim 1 wherein said layer of a heterocyclic multidentate ligand is a monolayer.

8. An electrode having a work function of less than 4.0 eV, consisting of:

a) nickel having a surface, b) a layer of a second metal coated directly upon the surface of said nickel, and c) a layer of a heterocyclic multidentate ligand coated in a monolayer directly upon the surface of said second metal, whereby the work function of said second metal surface is reduced.

9. The electrode of claim 8 wherein said second metal is chosen from the group consisting of alkali metals, alkali earth metals, lanthanide metals, and actinide metals.

10. The electrode of claim 8 wherein said heterocyclic multidentate ligand is chosen from the group consisting of crown-ethers, cryptands, aza-crown-ethers, cyclic-silicones, and thio-crown-ethers.

11. The electrode of claim 8 wherein said heterocyclic multidentate ligand is chosen from the group consisting of 15-Crown-5, 18-Crown-6, Cryptand [2.2.2] and hexamethyl hexacyclen.

12. An electrode, consisting of: a tungsten derivative having a surface directly coated with a monolayer of a heterocyclic multidentate ligand, whereby the work function of said tungsten derivative surface is reduced.

13. The electrode of claim 12 wherein said tungsten derivative is selected from the group consisting of thoriated tungsten, carburized thoriated tungsten and cesiated tungsten.

14. The electrode of claim 12 wherein said heterocyclic multidentate ligand is chosen from the group consisting of crown-ethers, cryptands, aza-crown-ethers, cyclic-silicones, and thio-crown-ethers.

15. The electrode of claim 12 wherein said heterocyclic multidentate ligand is chosen from the group consisting of 15-Crown-5, 18-Crown-6, Cryptand [2.2.2] and hexamethyl hexacyclen.

* * * * *